United States Patent [19]

Turner, Jr.

[11] 4,060,014

[45] Nov. 29, 1977

[54] POWER TONG

[75] Inventor: John W. Turner, Jr., Houston, Tex.

[73] Assignee: Joy Manufacturing Company, Pittsburgh, Pa.

[21] Appl. No.: 681,654

[22] Filed: Apr. 29, 1976

[51] Int. Cl.[2] ..... B25B 17/00

[52] U.S. Cl. ..... 81/57.2

[58] Field of Search ..... 81/57.11–57.15, 81/57.18, 57.19, 57.20, 57.21

[56] References Cited

U.S. PATENT DOCUMENTS

| | | | |
|---|---|---|---|
| 1,811,666 | 6/1931 | Foster | 81/57.13 |
| 2,668,689 | 2/1954 | Cormany | 81/57.18 |
| 3,025,733 | 3/1962 | Soodnizin | 81/57.19 |
| 3,180,186 | 4/1965 | Catland | 81/57.18 |
| 3,518,903 | 7/1970 | Hain et al. | 81/57.18 |
| 3,610,640 | 10/1971 | Bollin | 81/57.18 |
| 3,776,320 | 12/1973 | Brown | 81/57.18 |

*Primary Examiner*—James L. Jones, Jr.
*Attorney, Agent, or Firm*—Arnold B. Silverman

[57] ABSTRACT

An open head power tong for use in making-up and breaking-out joints of varying diameter such as drill pipe joints which provides for bi-directional operation with the tong housing remaining in the same position.

21 Claims, 10 Drawing Figures

POWER TONG

Power tongs for rotating casing, tubing and pipe in various operations associated with oil well work are well known in the art and are manufactured by various manufacturers. Such prior power tong are of various designs and the publically distributed power tong catalogues of the various manufacturers well illustrate the power tong prior art and additionally set forth the various manner in which power tongs are used and the various auxiliaries used with power tongs. Manufacturers such as Lamb, Weatherford, Byron Jackson, Joy, Eckel, Foster and Peck are all well known in the power tong art and a good overall understanding of the prior art is obtainable by reviewing their published literature on power tongs.

Rotating power tongs, with articulating jaws that grip pipe to make-up and break-out threaded connections, are generally classed as either open head or closed head tongs. Open head tongs have a lateral passageway that permits convenient engagement with the pipe by lateral movement. Closed head tongs do not have such a lateral passageway and must be installed by lowering the tong around the pipe, while the pipe is supported by slips, and locating the tong above the rig floor. The tong then remains around the pipe for subsequent making-up or breaking-out operations. A closed head tong is stripped over the pipe for removal when its service is no longer required.

The articulating jaw systems of some open head power tongs are unidirectional as their jaws close and grip the pipe when the tong rotates in one direction only. Rotation in the opposite direction retracts the jaws from the pipe and opens the passageway to permit lateral engagement or disengagement of the tong from the pipe. When it is desired to apply torque in the opposite direction, the complete tong assembly is manually inverted, rotated about its longitudinal axis through means provided for that purpose and reengaged with the pipe. Other types of open head tongs have a bidirectional jaw system which permits rotation of pipe in either direction without changing jaws or inverting the unit. Many designs of such high torque open head power tongs are only able to accommodate a relatively narrow range of pipe diameter with any given set of jaws. As an example, one type of tong, equipped with jaws for a nominal diameter of 4½ inches, cannot effectively grip the pipe when the diameter is oversize by more than 1/16 inch, approximately, or underside more than 3/16 inch, approximately. Further, the center of the pipe shifts to an eccentric position, with respect to the tong, when running on any diameter other than the nominal jaw size. While such eccentricity will normally not present a problem when working on casing or buting, because the allowable mill tolerance is not nearly that great a range, it does create difficulties when the tong is used on tool joints of drill pipe. Although tool joints are held to ± 1/32 inch on their diameter during manufacture, wear of ¼–⅜ inches on the diameter is not uncommon during their service life.

All known closed head power tongs, being manufactured at this time, employ a camming type of jaw system which jaws, regardless of how they are mounted or actuated, are capable of gripping a range of diameters with any nominal size jaw. As an example, existing tongs utilizing such jaw design can easily cover a diameter change of ½ inch and greater and continue to function very efficiently. Because the jaws cam inwardly as they are actuated to grip the pipe, the pipe remains in the center of the tong; therefore, the problem of eccentricity does not exist as it does with open head tongs.

Closed head tongs are considered to be bidirectional if they are capable of torquing pipe in either direction of rotation without inverting the unit. Reversing the biting direction of this type tong now requires a manual change of the jaws which is accomplished by (1) unbolting and raising a top cover, (2) removing each jaw individually from its pivot pin, inverting the jaw, and placing each on its pin, and (3) replacing the top cover. Although this can be done while the tong is around the pipe, the operation is not considered to be a desirable feature and is time consuming. Because closed head tongs normally stay around the pipe that is being handled in a well bore, the tong may be a hazard when well blowouts occur, since well blowouts often occur with very short notice and it may not be possible to get the tong off the pipe. Subsequent well control procedures can be severely impaired by the tong's presence around the pipe.

Accordingly, one object of this invention is to provide an open head power tong with a reversible pipe gripping means that is capable of rotating pipe in either direction without having to make any manual adjustment to the tong.

Another object of this invention is to provide a power tong having the pipe gripping jaws pivotally mounted in a driving rotor and thereby affording a rigid assembly with which to rotate pipe and the like.

A principal object of this invention is to provide an open head power tong which has the capability of gripping a broad range of pipe diameters without having to make jaw changes.

These and other objects of this invention will be better understood upon considering the following detailed description of the presently preferred embodiments of the invention and the illustrative drawings in which.

Figure 3:
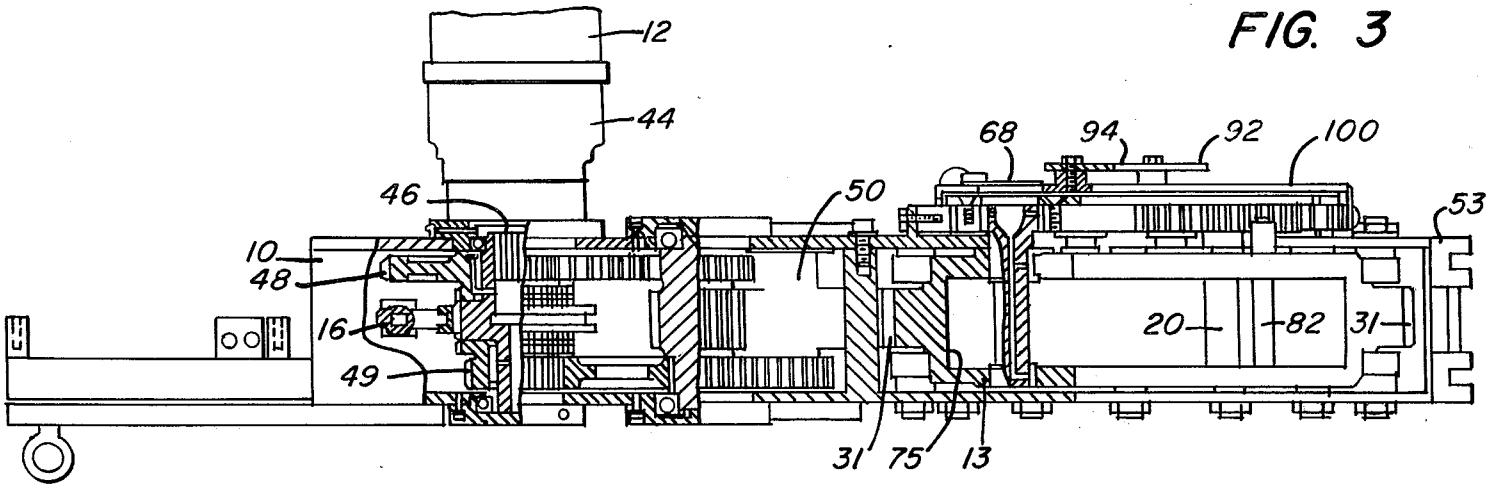
FIG. 3 is a longitudinal cross-sectional view of the tong as shown in FIG. 2 taken along the line 3—3 thereof without the jaws.
Figure 6:
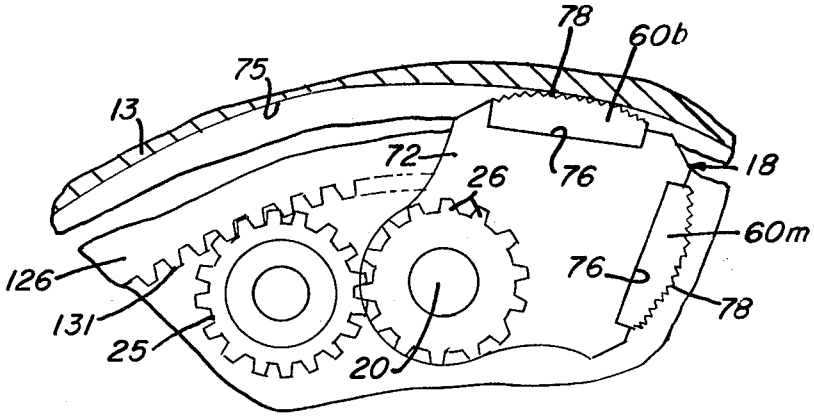
FIG. 6 is a diagrammatic and enlarged view of the left tong die of FIG. 7 in its makeup position with respect to the rotor of this invention.
Figure 1:
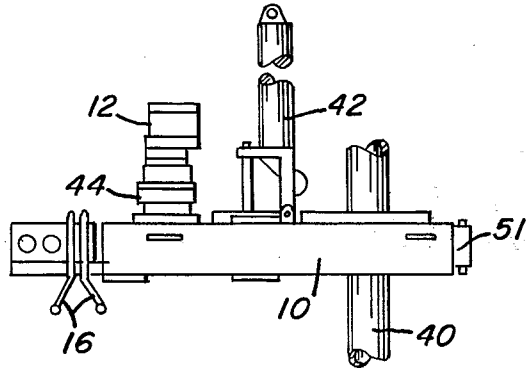
FIG. 1 is a side elevational view of a power tong of the structure of this invention.
Figure 2:
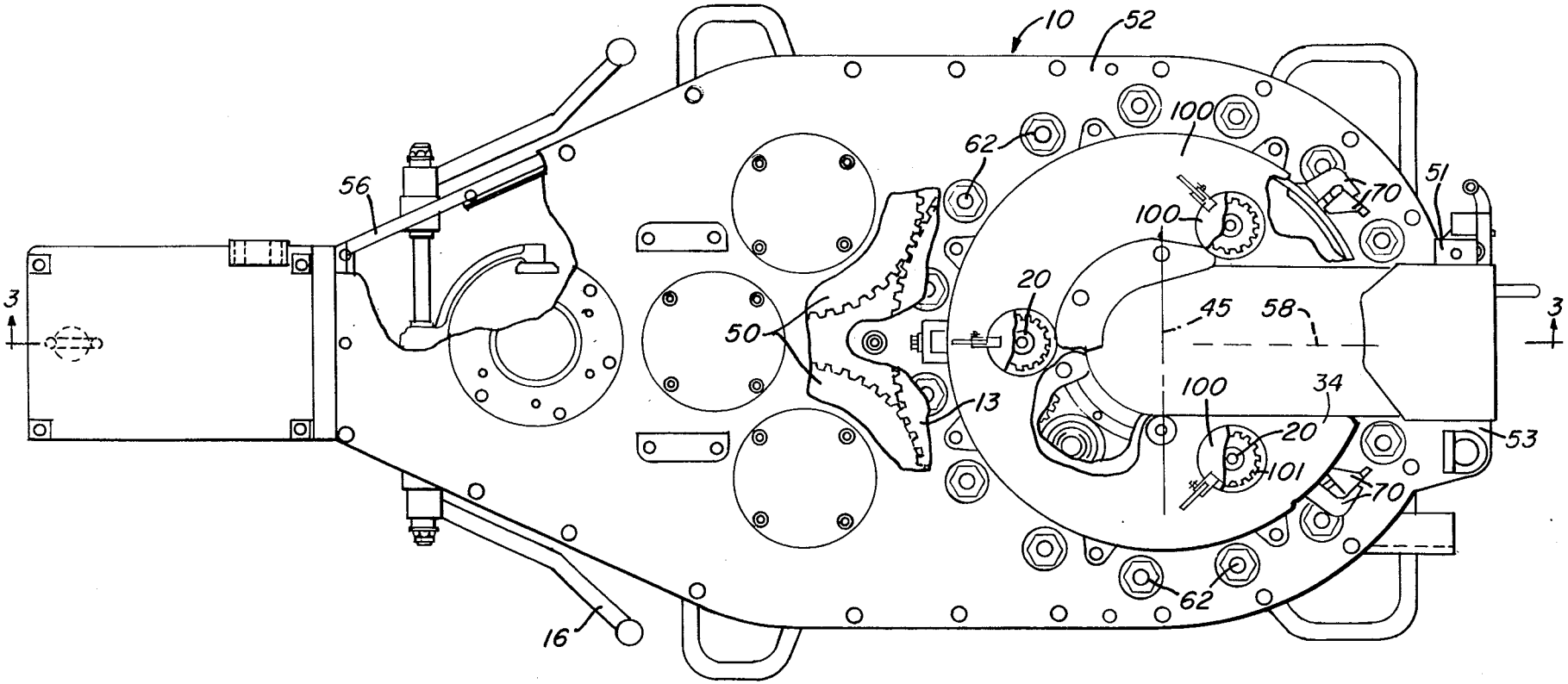
FIG. 2 is an enlarged top plan view of the power tong as shown in FIG. 1 having portions thereof removed to more clearly show the structure thereof.
Figure 4:
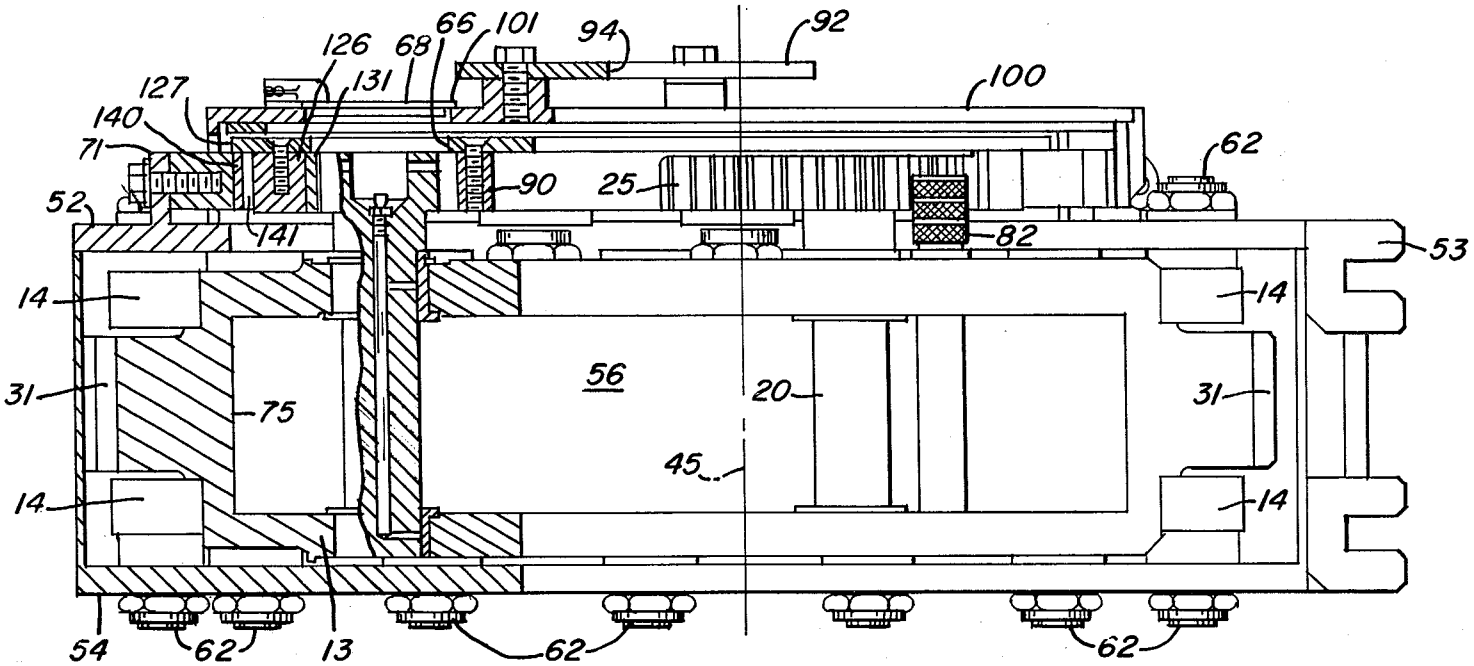
FIG. 4 is an enlarged view of the front portion of the tong as shown in FIG. 3.
Figure 5:
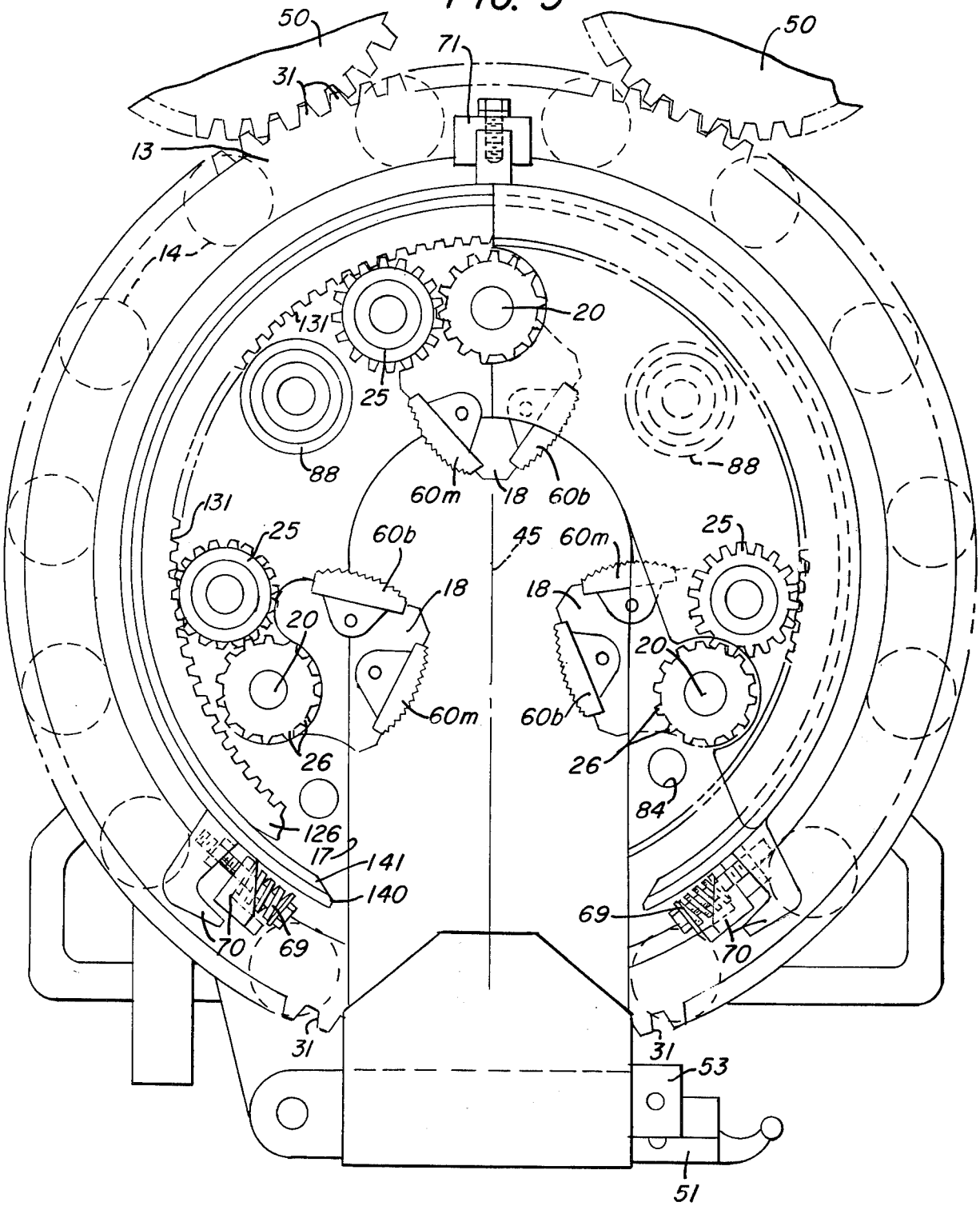
FIG. 5 is a diagrammatic top plane representation of various components of the tong as shown in FIG. 3.

The presently preferred embodiment of a power tong of this invention is shown in FIGS. 1 to 8, and comprises an elongated formed structural frame or housing 10 having a longitudinally inwardly extending through passageway 34 with an inner semi-circular end whereby the housing 10 is movable laterally of a drill pipe 40 (FIG. 1) to locate the drill pipe 40 at the inner portion of passageway 34. Housing 10 is supported in any suitable manner to provide such lateral movement such as a drill rig supported wire line (not shown) having its lower end suitably secured to an integral generally central post 42 extending upwardly of housing 10. A suitable reversible drive means or motor 12 such as a suitable electric, pneumatic or hydraulic motor is secured to the upper portion of a suitable reduction unit 44 which reduction unit 44 is rigidly secured to the housing 10 in any suitable manner. Such drive means 12, reduction unit 44, post 42 are commonly employed in power tongs in the same manner as has been generally described so that more specific description thereof is not necessary to the understanding of this invention by those skilled in the power tong art.

During operation of the power tong structure described herein the vertically extending central axis of an inserted drill pipe 40, insofar as practical, is coincident with the vertical central axis of the inner semi-circular end of passageway 34 and accordingly numeral 45 is utilized herein to identify such central axis of passageway 34. Further, the power tongs of this invention are moved laterally around and away from the drill pipe 40 since the drill string in which drill pipe 40 is an elongated member extending a substantial distance both above and below the housing 10. Thus, for ready understanding, the movement of the housing 10 onto the drill pipe 40 so that the drill pipe 40 is located coaxially with axis 45 is identified as the forward movement of the housing 10 and the portion of housing 10 forming passageway 34 is the forward portion of housing 10. The reverse movement of housing 10 laterally away from the pipe 40 is identified as rearward movement. Various components of the power tong structure are described as having left and right components and such left and right identification is with reference to the showing in FIGS. 5, 7 and 8 only as the terminology right and left is only for the purposes of better understanding the description of the power tongs and does not connote that such described components must be disposed to the left or right during actual use of the tong.

Housing 10 has upper and lower formed plate portions 52 and 54, respectively, and an outer side portion 56 extending vertically between the plate portions 52 and 54 throughout their entire periphery whereby housing 10 has a central cavity for receiving the hereinafter described components for drivingly engaging the drill pipe 40 and which cavity is open to the entire periphery of passageway 34. The upper and lower plate 52–54 have inner sides and the side member 56 has forward ends which form the sides of passageway 34 and such sides are laterally spaced an equal distance from the horizontal centerline 58 of housing 10 to define a passageway 34 of a sufficient width to freely receive the drill pipe 40. Such sides of passageway 34 preferably extend parallel to the horizontal centerline 58, however, they may have any suitable horizontal extent.

The output shaft 46 of the reduction unit 44 is selectively connectable by a suitable shiftable connection to either one of a pair of multiple gear trains for driving a pair of arcuately spaced output gears 50 to provide, as desired, a high speed, low torque output gear train drive 48 or a low speed, high torque output gear train drive 49. Such shiftable connection is controlled by a suitable external manual or power operable shift lever 16. Such selective high torque, low torque output drives are of any suitable construction having suitable gear train ratios and are located to provide a balanced gear drive for a rotor 13 which gear trains are well known in the art so that further description thereof is not necessary to the understanding of this invention to those skilled in the art of power tongs.

Rotor 13 (FIG. 5) is a formed generally circular member having an inwardly extending opening 17 which opening 17 is the same configuration as passageway 34 with the sides thereof being in vertical alignment or registry with passageway 34 when the tong is in the open position to permit a drill pipe 40 to be received within opening 17 in coaxial alignment with axis 45. Although such registry of opening 17 and passageway 34 is preferred, it is not essential for this invention that absolute registry be maintained. Rotor 13 is supported within housing 10 for relative rotational movement with respect to axis 45 by means of a suitable plurality of upper and lower guide rollers 14 pairs of which are suitably rotationally supported in vertical alignment by vertically aligned stub shafts 62 (only some of shafts 62 shown being identified by a numeral 62) suitably rigidly secured to the upper and lower plate portions 52–54. A suitable number of pairs of upper and lower rollers 14 rotationally engage rotor 13 to provide sufficient support for rotor 13 throughout the rotation thereof described herein. Rotor 13 is of a general U-shape in cross section with the bight portion thereof extending vertically between the arm portions thereof and with the arm portions being parallel and extending horizontally towards the axis 45. Rotor 13 has integral arcuately extending gear teeth 31 on the entire outer periphery thereof which extend verticaly between the vertically spaced roller 14. Gears 50 drivingly engage arcuately spaced portions of gear teeth 31 located on opposite sides of the horizontal axis 58. The outer surfaces of the vertically spaced pairs of rollers 14 rollingly engage vertically extending and vertically aligned upper and lower surfaces on rotor 13 spaced radially towards the axis 45 from the gear teeth 31 whereby rotor 13 is reversibly driven by the gears 50.

The arm portions of rotor 13 preferably have three pairs of arcuately spaced vertically aligned through bores (FIG. 10) radially spaced from the ends thereof and outwardly from the axis 45 for receiving vertically extending jaw pins 20 of identical structure therein respectively. Identical jaws 18, for gripping the drill pipe 40, are carried by jaw pins 20, respectively, and since the purpose of a power tong is to rotate the drill pipe 40 the jaws 18 are circumferentially spaced about the central axis 45 to obtain proper driving engagement. As is known in a three jaw drive system, a spacing of 120° of the rotation axis of the jaws is preferable and, accordingly, in this invention such 120° spacing is employed; however, other jaw spacings can be employed if desired or an increased number of jaws with appropriate circumferential spacing can be employed if desired. With the illustrated preferred three jaw spacing an innermost jaw pin 20 is located with its central vertical rotational axis coincident with the horizontal axis 58 and with the central vertical rotational axes of the other two jaw pins 20 being spaced 120° from the innermost jaw pin 20 in opposite forward and arcuate directions on a given diameter circle concentric with the axis 45.

Jaw pins 20 may be directly received within the bores; in the arm portions of rotor 13; however, hardened steel inserts 24 are, as shown, preferably suitably received within such bores with jaw pins 20 being rotationally received in vertically aligned through bores in the inserts 24. The upper insert 24 has an outwardly extending flange and each jaw pin 20 is laterally enlarged above the upper insert 24 to provide a shoulder for locating pins 20 axially of the inserts 24 and to provide a lower surface rotationally engageable with the upper surface of the flange of the upper insert 24. The uppermost portion of each pin 20 is laterally larger than all other portions of the pin and is provided with formed gear teeth 26 around the entire periphery thereof which gear teeth 26 (FIG. 5) matably engage gear teeth on the outer periphery of respective adjacent idler gears 25. Gears 25 are suitably rotationally supported by the rotor 13 with the teeth of the idler gears 25 being in constant meshing engagement with the adjacent teeth 26 on pins 20 respectively. The teeth of idler gears 25 are also in constant meshing engagement with gear teeth 131 on the entire inner periphery of an arcuate brake drum 126 suitably rigidly carried by a formed brake plate 127 having a circular outer periphery. Brake plate 127 (FIG. 7) overlies the major portion of rotor 13 as hereinafter described and has, when opening 17 and passageway 34 are in registry, a forwardly diverging opening 80 as is more specifically described hereinafter. Suitable openings 66 are provided in brake plate 127 selectively alignable with the forward pins 20, respectively, to permit the removal of pins 20. Brake drum 126 engages an arcuate suitable composition brake shoe 141 supported by a substantially coextensive arcuate brake band 140 suitably rigidly secured to the plate portion 52. Brake shoe 141 is biased into engagement with brake drum 126 in any suitable manner such as springs and adjustable bolt assemblies 69 suitably supported by spaced lugs 70 with one lug 70 being rigidly carried by the brake band 140 and the other lug 70 being rigidly carried by the plate portion 52. An adjustable lug assembly 71 is carried by the plate portion 52 and brake band 140 at the innermost portion of the brake band 140 on the axis 58. Thus the bias between the brake drum 126 and the brake shoe 141 can be varied as desired by adjustment of the assemblies 70 and 71. A suitable cover 100 is suitably rigidly supported by plate portion 52 which overlies the brake plate 127 and is of a form to permit the described placing of the tong about the pipe 40. If desired for safety reasons suitable movable covers 68 may be secured to the cover 100 to uncover opening 101 in cover 100 with which openings 66 are alignable to prevent undesired access to pins 20.

Each jaw pin 20 suitably supports a jaw 18 for rotation therewith. Each jaw 18 has a formed body 72 located between the arm portions of rotor 13 having a through bore 74 therein for removably receiving a pin 20 therein. Each bore 74 and jaw 20 has one or more suitable cooperable keys and keyways to permit the pin 20 to be removed and be reinserted with the same relative positioning of the jaw 18 and pin 20 and to permit the pins 20 to rotate the jaws 18 as hereinafter described. Each jaw 18 is locatable internally of the rotor 13 to permit the insertion of the drill pipe 40 within housing 10 without interference from the jaws 18.

A significant improvement over the prior art is in the structure of jaw 18 whereby the power tong is utilizable for joint makeup or break-out without requiring any repositioning of the housing 10. Body 72 of each jaw 18 (FIG. 6) has a pair of elongated formed recesses or sockets 76 for receiving identical elongated dies **60*m* and 60*b* respectively. The longitudinal extent of sockets 76 are at an acute angle to each other such that dies 60*m* engage the pipe 40 for joint makeup and dies 60*b* engage the pipe 40 for joint break-out. Each die 60*m* and 60*b* has an elongated body which is closely received within a socket 76 and a serrated face 78 located outwardly of the jaw body 72 such that the jaw body 72 does not interfere with the engagement of the serrated face 78 with the pipe 40. Inasmuch as dies 60*m* and 60*b* become worn in service they must be, as a practical matter, replaceable and a suitable structure is provided for permitting removal of the dies 60*m* and 60*b* which as shown (FIG. 10), comprises an intermediate inwardly extending stem on dies 60*m* and 60*b* closely received in central inwardly extending recesses in the body 72 with such stem and the body 72 having aligned bores for removably receiving suitable retaining pins 80 for dies 60*m* and 60*b***.

The faces 78 of dies **60*m* and 60*b* are of a configuration to provide a camming action with reference to the direction in which they engage a pipe joint which configuration is well known in the art so that further description thereof is not necessary to the understanding of this invention to one skilled in the power tong art. See, for example, an early description of such dies in U.S. Pat. No. 1,811,666. Such die configuration is identified as self-energizing in that as continued rotation of the die in the direction of pipe engagement causes the die to more firmly grip the pipe. Inasmuch as such dies only provide a camming action in one direction with reference to the drill pipe 40 the face 78 of die 60*m* is located to provide a camming action on joint makeup and the face 78 of die 60*b* is reversed with reference to face 78 of die 60*m*, to provide a camming action on joint break-out. Since dies 60*m* and 60*b* are identical in form, either die can be supported within either socket 76 with the face 78** thereof properly oriented.

In operation the rotor 13 is reversibly driven by gears 50 and selectively rotates with respect to and bodily with brake plate 127. During portions of the rotation of rotor 13, the idler gears 25 and gear teeth 26 also rotate. In view of such rotation of the various structural elements, the centers of rotation of teeth 31, teeth 131, pins 20, gears 50, gears 25, rotor 13, brake drum 126, brake plate 127, jaws 18, and rollers 14 the surfaces of rotor 13 engaged by rollers 14, the vertical peripheral surface 75 extending between the arm portions of rotor 13 radially outwardly of axis 45, and the outer peripheral surface of brake drum 126 are on circles coaxial with axis 45 and radially spaced from axis 45 to provide the operation described herein. The stationary brake shoe 141 also has its inner peripheral surface on a circle coaxial with axis 45. Preferably, the outer peripheral surface of the brake plate 127 is vertically aligned with the outer peripheral surface of the brake band 140 and brake band 140 has an outer vertically extending arcuate surface on a circle concentric with axis 45; however, such relationship may be varied as desired, providing proper operation of the tong is maintained.

In the joint makeup position, each jaw 18 is located in position A (FIG. 6) with the dies **60*b* engaging the vertically extending surface 75 of rotor 13 spaced radially outwardly with respect to axis 45 from the free ends of the arm portions of rotor 13. In position A, the opening 17 and passageway 34 are in registry and the right side of opening 80 (FIG. 7) is in registry with the right side of opening 17 and passageway 34. In position A, each jaw 18 is located between the arm positions of rotor 13. With such alignment of such structure a drill pipe 40 is insertable within passageway 34, opening 17** and opening 80 with the central axis of pipe 40 coincident with axis 45. Upon proper energization of motor 12 and location of lever 16, the rotor 13 is rotated in a clockwise direction for joint makeup through the selected driving gear train 48 or 49, gears 50 and teeth 31 on the rotor 13. The brake drum 126 is restrained by the brake shoe 141 during the initial rotation of rotor 13 and the brake plate 127 and brake drum 126 remain stationary. Since the pins 20 and idler gears 25 are bodily carried by the rotor 13 the initial clockwise movement of rotor 13 bodily moves the pins 20 and idler gears 25 clockwise; however, due to the engagement of the teeth on the idler gears 25 with the stationary teeth 131 on the restrained brake drum 126 during such initial clockwise movement, the idler gears 25 are simultaneously uniformly rotated with respect to the rotor 13 in a counterclockwise direction which counterclockwise rotation of gears 25 simultaneously uniformly rotates the pins 20 clockwise with respect to the rotor 13 due to the engagement of the teeth on the turning idler gears 25 with the gear teeth 26 on the pins 20. Thus, during the initial rotational movement of rotor 13 the stationary brake drum 126 and idler gears 25 provides for rotating pins 20 relative to the rotating rotor 13. Clockwise rotation of pins 20 in turn causes simultaneous uniform clockwise rotation of jaws 18 keyed thereto out from the initial A position into the passageway 34 and thence into engagement with the outer surface of the drill pipe 40. Inasmuch as the motor 12 is preferably initially connected to the gear train 48 for high speed, low torque output for joint makeup, such clockwise rotation of the jaws 18 will occur rapidly such that the serrations of faces 78 of the dies **60*m* firmly grip the drill pipe 40. With the dies 60*m* firmly engaging the drill pipe 40 the high speed rotation of rotor 13 is continued to obtain the initial makeup of the drill pipe joint; however, the engagement of the dies 60*m* with the pipe 40 prevents the gear teeth 26 on pins 20 from rotating relative to the rotor 13 which in turn prevent idler gears 25 from rotating relative to the rotor 13. Since the idler gear teeth engage the gear teeth 131 on the brake drum 126, continued rotation of the rotor 13, after the jaws 18 are in engagement with the pipe 40, overcomes the frictional resistance between the brake shoe 141 and the brake drum 126 so that the rotor 13, pins 20, engaged jaws 18, idler gears 25, brake plate 127 and brake drum 126 rotate as a unit relative to housing 10 and are hereinafter identified as the unit assembly. In rotating the unit assembly the gear trains of teeth 26, the teeth of idlers 25 and teeth 131 are, in common terminology, "locked up." High speed rotation of the unit assembly is continued in the joint makeup until such time as the low speed drive 49 is desired to provide a high torque on the drill joint. Thus, at some time period after rotation of the unit assembly has occurred the operator shifts the lever 16 to provide a high torque drive 49 to the drill pipe 40. During such shifting the jaws 18 are momentarily released with respect to the drill pipe 40**; however, such momentary release is extremely minimal and is not detrimental during the joint makeup. During such high torque makeup the unit assembly continues to be rotated until the desired makeup torque is applied to the joint. The high and low speed drive is desired for practical reasons in operating a drill rig but is not essential to this invention inasmuch as a single speed drive having sufficient drive capability can be employed if desired.

Once a joint has been properly made up, the controls for the motor 12 are positioned to initiate counterclockwise rotation of the rotor 13 and, although not shown, suitable controls for the motor 12 are preferably suitably carried at the rearward end of housing 10 so as to be readily accessible. Initiation of counterclockwise rotation of rotor 13 causes immediate release of the grip or engagement of the faces 78 of dies **60*m* with the pipe 40 and an immediate release of the prior "locked-up" gear trains of the unit assembly. Upon such release of the dies 60*m* and consequent release of the gear trains of the unit assembly the pins 20 and idler gears 25 are bodily moved counterclockwise with the counterclockwise rotating rotor 13. Since the jaws 18 are free of the pipe 40 the engagement of the brake shoe 141 with the brake drum 126 prevents the brake drum 126 and brake plate 127 from rotating. Consequently, teeth 131 of brake drum 126 are stationary such that the counterclockwise bodily movement of idler gears 25 with respect to teeth 131 rotates gears 25 clockwise which in turn rotates the gear teeth 26 and pins 20 counterclockwise with respect to rotor 13. Such counterclockwise rotation of pins 20 rotates the jaws 18 counterclockwise and inwardly of the arm portions of rotor 13 to the initial A position at which the outer faces 78 of the jaw dies 60*b* again engage the inner surface 75 at which instant the gear trains of the unit assembly are again "locked up" so that the unit assembly again rotates as a unit. The counterclockwise rotation of rotor 13 is continued so that the unit assembly are rotated counterclockwise until the opening 17 and opening 80 is in registry, as described, with the passageway 34 to permit the entire tong to be laterally withdrawn from around the pipe 40. Thereafter, the entire tong is laterally movable about the next pipe joint of another drill pipe (not shown) identical to pipe 40 to permit joint makeup in the same manner as described. With the opening 17 and passageway 34 in registry after joint makeup the innermost pin 20 is again located on the horizontal centerline 58; however, precise alignment with centerline 58 is not critical to this invention. A non-alignment of opening 17 and passageway 34 is not desired as one end of rotor 13 would extend into the passageway 34 by an arcuate extent equal to the arcuate displacement of the innermost pin 20 from the centerline 58**.

Jaws 18 are movable with respect to rotor 13 to a break-out position B (FIG. 8) at which die **60*m* engages surface 75. As heretofore described, to move jaws 18 clockwise from position A, the rotor 13 is rotated clockwise. When there is no pipe 40 located with passageway 35, clockwise rotation of rotor 13 will rotate jaws 18 from position A to position B since the brake shoe 141 prevents the brake plate 127 from rotating until the dies 60*m* of jaws 18 engage the surface 75. With dies 60*m* of jaws 18 engaging the surface 75 of rotor 13 the drive unit 12 will again rotate the unit assembly. In moving the jaws 18 from the A position into the B position the opening 17 of rotor 13 is not aligned with passageway 34 of housing 10 since the rotor 13 has moved, with respect to the housing 10 and brake plate 127, an arcuate clockwise distance about axis 45 necessary to obtain the shift in the jaws 18 from position A to position B. Specifically, the right end of opening 17 (FIG. 7), which is in registry with the right side of passageway 34 when the jaws 18 are in the A position, moves arcuately into the horizontal extent of passageway 34 as the jaws 18 are moved to the B position. Consequently, the clockwise rotation of the rotor 13 is continued after dies 60*m* of jaws 18 have engaged surface 75 in position B until the opening 17 of rotor 13 is again in registry with the sides of passageway 34**.

Figure 7:
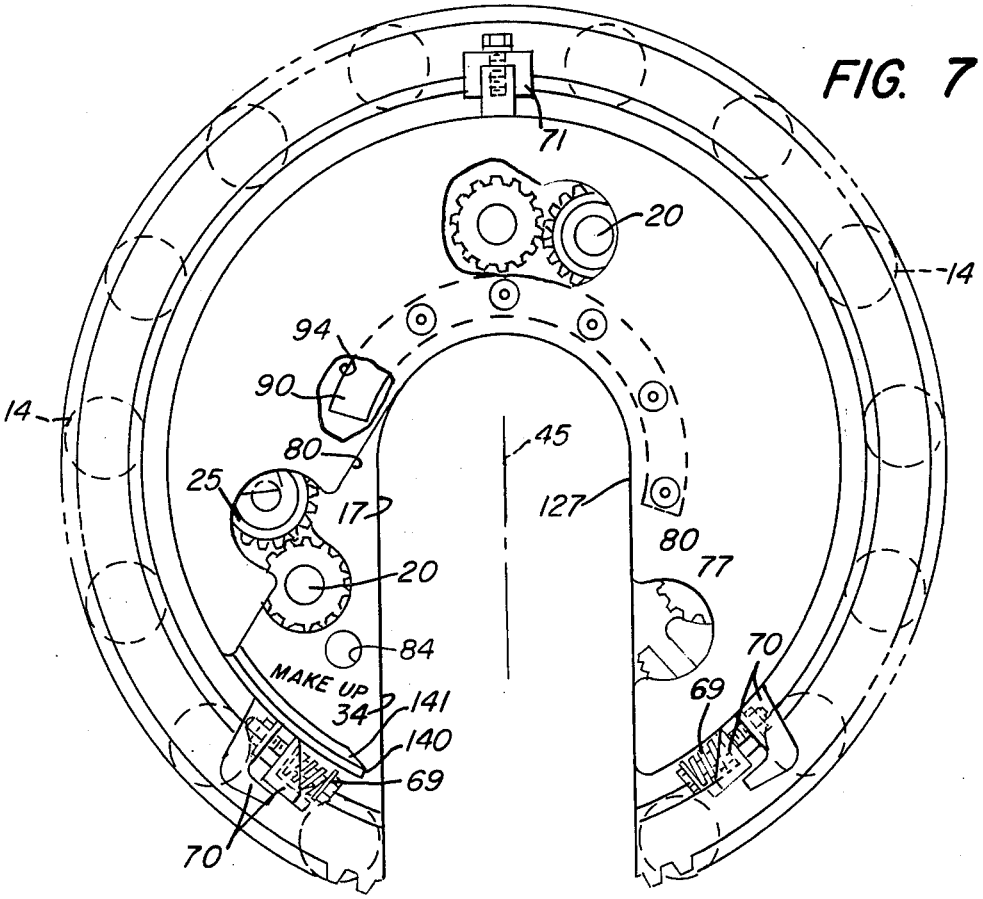
FIG. 7 is a top plan view of the interior structure of the tong as shown in FIG. 1 having the brake plate thereof located in the makeup position.

During the arcuate movement of rotor 13 to shift jaws 18 from position A to position B, the position of rotor 13 relative to brake plate 127 has changed so that the forward opening 80 in the brake plate 127 is no longer in the same relative position with respect to rotor 13. Consequently, the opening 80 must be larger than the opening 17 and passageway 34 to accommodate for such change in relative position of brake plate 127 with respect to the rotor 13. Such accommodation is obtained by having the opening 80 of the brake plate 127 of a greater arcuate extent that the arcuate extent of openings 17 and passageway 34 with such greater arcuate extent of opening 80 being at least equal to the arcuate extent of travel of the rotor 13 in moving the jaws 18 from the A position to the B position. Specifically, as the right end of rotor 13 (FIG. 7) moves into the extent of passageway 34 in moving the jaws 18 from the A position to the B position the right side of opening 80 remains in registry with the right side of passageway 34. Thus, when rotor 13 is further rotated clockwise to locate opening 17 and passageway 34 in registry with jaws 18 in the B position the right side of opening 80 trails the right end of rotor 13 by the number of degrees the right end of rotor 13 has moved into the passageway 34. With jaws 18 in the B position and opening 17 and passageway 34 in registry, the left side of opening 80 (FIG. 8) is in registry with the left side of opening 17 and passageway 34. From such description it will be noted that in moving jaws 18 from the B position to the A position the reverse relative movement between rotor 13 and brake plate 127 occurs and the right side of opening 80 is in registry with the right side of opening 17 and passageway 34 (FIG. 7). With jaws 18 in the A position, the left side of opening 80 is located within housing 10 an arcuate distance equal to the arcuate distance the rotor 13 has moved relative to brake plate 127 in moving the jaws 18 from the B to A position.

Inasmuch as the shifting of the jaws 18 between positions A and B only occurs when a pipe 40 is not located within the housing 10 and the jaws 18 are located within the rotor 13 so as not to be visually observable in both the A and B positions, it is possible for a careless operator of the power tong to actuate the drive 12 to obtain an undesired shift of the jaws 18. Also since a careless operator may not have the jaws 18 in the proper A or B position when there is a pipe 40 in opening 35 it is possible to obtain improper operation of the power tong. In particular, with a pipe 40 being in position in opening 35 for break-out and with the jaws 18 being in the makeup position A, actuation of the jaws 18 into engagement with the pipe 40 can result in undesired movement of the power tong as is well known in the art such that further description thereof is not necessary for the understanding of this invention. To ensure that the operator knows what position the jaws 18 are in, a pin 82 of a suitable configuration is removably captively received in either one of vertically aligned through bores 84 in the arm portions of the rotor 13 with a pair of such aligned bores being located inwardly adjacent the left and right ends of rotor 13 and with one of said pairs of bores 84 being located in the path of movement of jaws 18 as jaws 18 are moved from the A and B position and with the other pair of said bores 84 being located in the path of movement of jaws 18 as jaws 18 are moved from the B to A position. Thus, (FIG. 7), the left vertically aligned bores 84 are located in rotor 13 such that with the pin 82 therein the leading edge of left jaw 18, as left jaw 18 moves from the A position towards the B position, engages the left pin 82 to prevent the left jaw 18 from being positionable in the B position. Similarly (FIG. 8), the right vertically aligned bores 84 are located on rotor 13 to prevent the right jaw 18 from moving into the A position when pin 82 is in the right bores 84. Additionally, the rotor 13 has a clearly visible notation MAKE-UP adjacent the left bores 84 and a notation BREAK-OUT adjacent the right bores 84. An operator knowing in what direction he is running pipe, i.e., pipe 40, into or out of the hole, will locate pin 82 in accordance with the desired makeup or break-out operation of the power tong. Thus, on makeup the pin 82 will be aligned with the left bores 84 and if pin 82 is insertable the jaws 18 are in the A position; or, if the pin 82 in not insertable due to the left jaw 18 being in the B position the operator will then drive the power tong to locate the jaws 18 in the A position and thereafter insert the pin 82 in the left openings 82. Each pair of bores 84 are also located in rotor 13 so that when engaged by a jaw 18 the engaged jaw 18 extends into the passageway 34 and accordingly, the other jaws 18 also extend into the passageway 34, since the jaws 18 move uniformly as described, to prevent the insertion of a drill pipe 40 within the passageway 34. Thus, an operator by placing the pin 82 in either right or left aligned bores 84 knows the position of the jaws 18 within housing 10 without actually seeing the jaws or otherwise checking the position of the jaws 18.

With jaws 18 in the break-out position, counterclockwise rotation of the motor 12 rotates the rotor 13 and initially rotates the jaws 18 counterclockwise into engagement with the drill pipe 40 for joint break-out. On break-out, further counterclockwise rotation of rotor 13, after such initial counterclockwise rotation of the jaws 18, rotates the unit assembly counterclockwise to separate the threaded joints of the drill pipes 40 being uncoupled or unthreaded. After the drill joint is unthreaded clockwise rotation of rotor 13 rotates the jaws 18 into the B position of housing 10. All the rotational movements on joint break-out are the same as those heretofore described for joint makeup; however, the directions of rotation are reversed as jaws 18 must be rotated counterclockwise from the B position to engage the drill pipe 40. Accordingly, the prior detailed description of joint makeup sufficiently describes the operation of the power tong on break-out upon recognizing the difference in the position of the jaws 18. Also, the low speed high torque drive 49 is normally utilized to initially break-out a drill joint and thereafter the high speed low torque drive 48 is utilized to further unthread the drill joint.

During the periods the brake plate 127 and brake drum 126 are rotated as a part of the unit assembly the frictional loading or biasing force applied to the break drum 126 by the brake shoe 141 will vary due to the fact that the brake shoe 141 and the brake drum 126 do not have engagement throughout an arc of 360° and are not coextensive at all times. Thus, (FIG. 7), as rotor 13 and brake plate 127 rotate clockwise as the unit assembly the right side of opening 80 will move into the horizontal extent of passageway 34 and the area of the brake drum 126 engaged by the brake shoe 141 will continually decrease until the trailing edge of opening 80 reaches the left end of the brake shoe 141. Upon counterclockwise rotation of the brake drum 126 the opposite engagement occurs between the brake shoe 141 and the brake drum 126.

When the teeth 131 on brake drum 126 are engaged by all three idler gears 26 the idler gears 26 laterally support the brake drum 126 and the brake plate 127; however, during the rotation of brake plate 127 the idler gears 26 will sequentially disengage teeth 131 such that the forward bias applied by the brake band 140 to the brake plate 127 will vary. Such variation in load applied to the rotating brake drum 126 and brake plate 127 requires that the brake plate 127 be supported so that its axis of rotation remains substantially coincident with axis 45. To provide such support an arcuate ring segment 90 is suitably rigidly secured to the underside of the brake plate 127 radially outwardly with respect to axis 45 of opening 80 which is rollingly engageable by rollers 88 rotatively supported by rotor 13. Ring segment 90 extends in opposite arcuate directions with relation to the axis 58 and is located radially forwardly of rollers 88 with respect to axis 45 to ensure that the outer surface of rollers 88 are located to engage the outermost arcuate surface of ring 90 with respect to axis 45 throughout the unit assembly rotation. Rollers 88 are arcuately spaced with respect to axis 45 a suitable distance to permit all other components of the power tong to operate as described. Inasmuch as the relative movement of rotor 13 with respect to the brake plate 127 is limited to the before described unrestrained initial movement of the jaws 18, the rollers 88 are displaced the same arcuate extent relative to the ring segment 90 and accordingly, ring segment 90 is of an arcuate length to be adjacent rollers 88 throughout the relative movement of rotor 13 and brake plate 127. Upon unit assembly rotation, rollers 88 and ring segment 90 uniformly bodily rotate and when the opening 80 faces rearwardly the innermost idler gear 26 is disengaged from the teeth 131 of brake drum 126 whereby the maximum forward bias is applied to the brake plate 127 by the brake band 140. Accordingly, the brake plate 127 is biased forwardly and when such bias is sufficient the outer, with respect to axis 45, arcuate surface of ring segment 90 engages rollers 88 whereby such bias is resisted by the roller 14 supporting the rotor 13. Since ring segment 90 and rollers 88 rotate together they are always cooperatively located as described throughout the unit assembly rotation. The rotation axes of rollers 88 and the arcuate surface of ring segment 90 are on diameters coaxial with axis 45.

Inasmuch as the diameter of drill pipe 40 to be handled by the power tong varies, the arcuate surface on housing 10 forming the innermost end of passageway 34 is of a size to permit the largest pipe 40 diameter to be inserted into passageway 34 for which the power tong is designed. For smaller diameter pipes 40 such arcuate surface on housing 10 need not be located as far inwardly of housing 10; accordingly, to facilitate locating the central axis of a small diameter pipe 40 coincident with the central axis 45 an adaptor plate 92 is suitably removably and rigidly secured to cover 100 to define a fixed arcuate surface 94 radially inwardly with respect to axis 45 of the inner arcuate surface of passageway 34. Thus, smaller diameter pipe 40 will not travel as far inwardly of housing 10 with adaptor plate 92 in position so that the central axis of such smaller diameter pipe 40 will be closer to the axis 45 upon insertion. Consequently, the jaws 18 will encounter less eccentricity between the central axis of the smaller diameter pipe and axis 45 so that less camming of the pipe is required to obtain concentricity between the central axis of the smaller drill pipe and the axis 45.

In view of the high torque output requirements for a power tong a suitable door 51 is pivotally secured to one side of housing 10 outwardly adjacent passageway 34 and a suitable latch 53 is provided on the other side of housing 10 to permit the door 51 to be latched to the housing 10 during operation and to be movable to open passageway 34 when desired. Such door 51 is of any suitable structure and is pivotally secured and latched to housing 10 all as is well known in the art such that further description is not necessary to the understanding of this invention to one skilled in the art.

Figure 8:
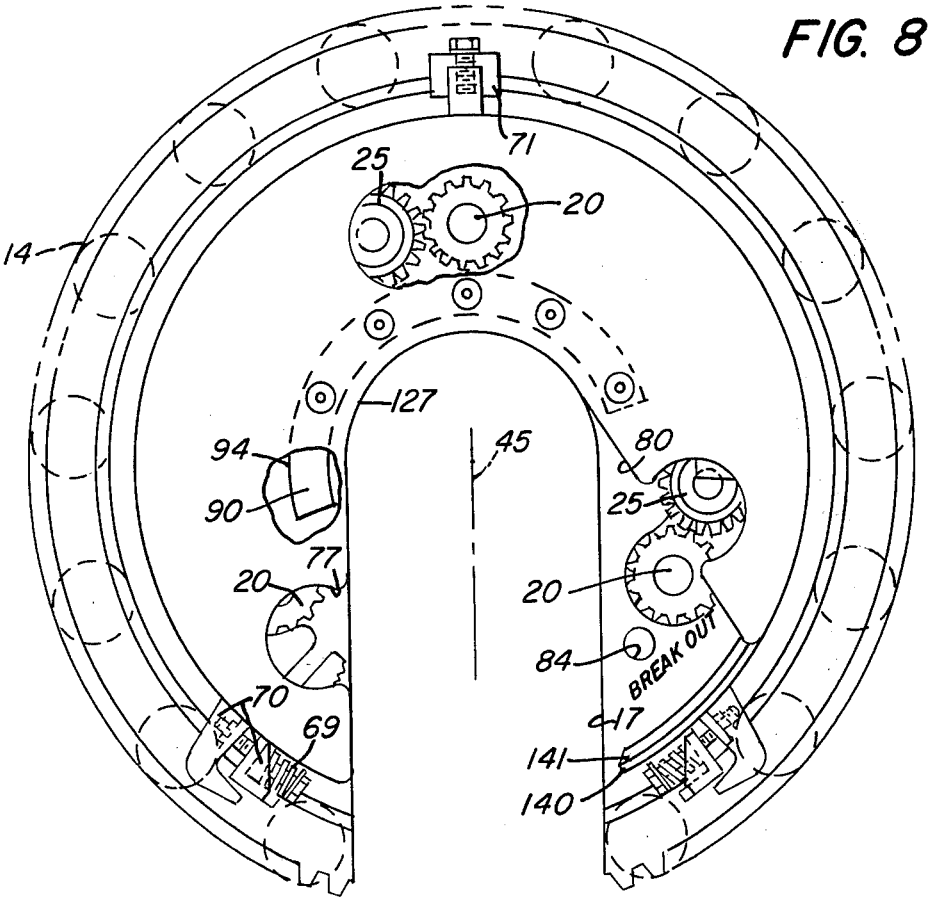
FIG. 8 is a view similar to FIG. 7 with the brake plate being located in the brake-out position.

With regard to power tongs, the power tong heretofore described is readily operated by a proper drill rig worker. Assuming the operator starts with the tong in the makeup position as shown in FIG. 7, that the operator does not know the position of jaws 18, the operator intends to change the jaws 18, and the operator drives the rotor 13 in either of the drive modes available to the operator through the drive controls. Such initial determination of the status of the power tong is done without locating the tong around the pipe 40. If the operator drives rotor 13 counterclockwise for breakout, the jaws 18 will remain engaged with surface 75 and the left bores 84 with pin 82 therein will enter passageway 34 and the operator can by visually observing the pin 82 determine that jaws 18 are in the makeup position. Accordingly, counterclockwise rotation of rotor 13 is continued until the openings 101 are in alignment with openings 66 in brake plate 127 at which time covers 100 are lifted, pins 20 removed through openings 66 and 101, and jaws 18 removed through passageway 34. New jaws 18 are inserted within the rotor 13 and reinsertion of pins 20 ensure proper orientation of the jaws 18 with respect to the rotor 13. Thereafter the new jaws are ready to be employed for joint makeup. Hand the operator initially driven rotor 13 clockwise, jaws 18 would enter passageway 34 which the operator can visually determine and realize the jaws 18 are in the makeup position. Accordingly, the counterclockwise drive of rotor 13 is continued until openings 66 and openings 100 are in registry at which time jaws 18 are replaced as previously described. Similar observations are available to the operator should the operator have started the power tong with the tong initially being in the breakout position (FIG. 8).

In the event the operator wants to relocate the pin 82 the rotor 13 is driven until the pin 82 emerges into passageway 34 and thereafter the rotation of rotor 13 is reversed so that the non-pinned bores 84 enter passageway 34 at which time the non-pinned bores are pinned by inserting pin 82.

For purposes of facilitating the operation heretofore described the free edges of the brake shoe 141 and the brake band 140 and the brake drum 126 are suitably tapered, to facilitate the rotational entry of the brake drum 126 into the brake shoe 141. Also lugs 70 are preferably provided with integral means, not shown, engageable with the housing 10 or any part rigid therewith to limit the travel of the free ends of the brake shoe 141 and the brake band 140 inwardly relative to the housing 10.

Figure 9:
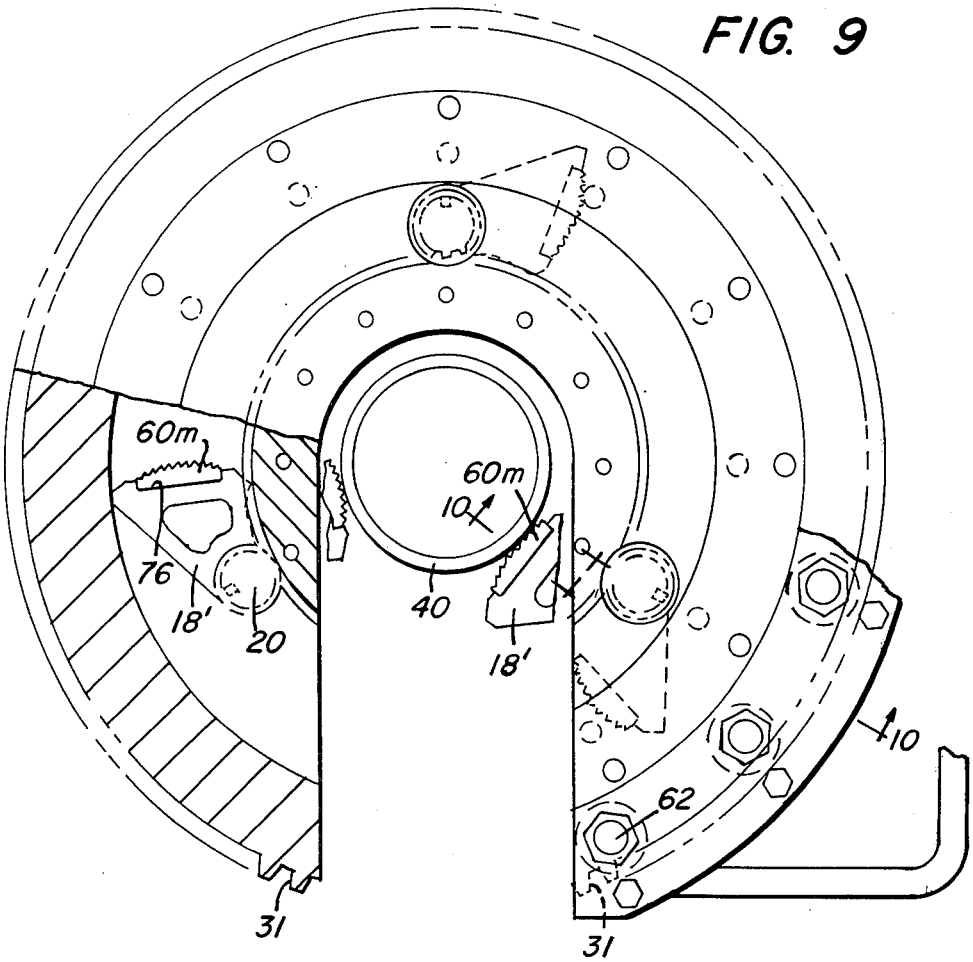
FIG. 9 is a top plan view of the forward portion of an alternate embodiment of a tong of this invention.
Figure 10:
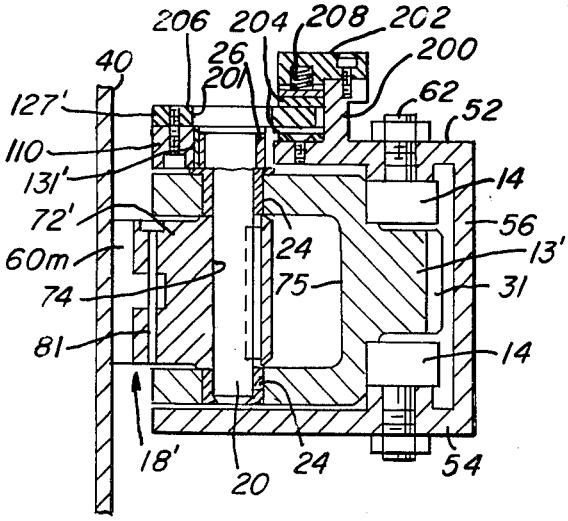
FIG. 10 is a cross-sectional view of the structure shown in FIG. 9 taken along the lines 10—10 thereof.

Having described the preferred embodiment of this invention as required by the patent statutes, it is to be realized that the entire structure of the described preferred embodiment need not be utilized to obtain a practical power tong having substantial and novel advantages over the prior power tongs. Accordingly, another version of a practical power tong is illustrated in FIGS. 9 and 10 in which components which are the same as previously described components have been identified by the same reference numerals and components which are similar in function to components previously described but which differ in some aspect have been identified by the same reference numeral primed. Inasmuch as certain components of FIGS. 9 and 10 are the same for each illustrated embodiment, FIGS. 9 and 10 have been referred to in describing the embodiment shown in FIGS. 1 to 8.

In the embodiment of FIGS. 9 and 10 a brake drum 126′ has gear teeth 131′ which engages the gear teeth 26 of the jaw pin 20 so that idler gears 25 are not utilized. A different brake system is also shown which requires a modified rotor 13′. The same brake system as heretofore described may be used if desired in the embodiment of FIGS. 9 and 10. With the brake system illustrated in FIGS. 9 and 10 the rotor 13′ differs from the rotor 13 in that rotor 13′ has a formed flange 200 extending upwardly from the upper surface of the upper arm portion which flange 200 extends arcuately, with respect to axis 45, throughout the extent of rotor 13′ and is spaced radially outwardly, with respect to axis 45, from the free end of the upper arm portion of the rotor 13′. A suitable arcuate support 202 is rigidly supported on the upper portion of flange 200 which extends from flange 200 towards the axis 45. A vertically spaced pair of suitable arcuate brake shoes 204 are carried by the support 202 and the upper surface of rotor 13′, respectively, which extend radially inwardly, with respect to axis 45, adjacent the flange 200. The brake plate 127′ has an arcuate horizontal portion 206 with its radial outermost portion, with respect to axis 45, being located between the brake shoes 204. A suitable plurality of circumferentially spaced springs 208 are suitably carried by the support 202 to bias the upper brake shoe 204 into engagement with the upper surface of the portion 206. Support 202 is adjustable with respect to the flange 200 in any suitable manner to provide for adjusting the bias between the horizontal portion 206 and the brake shoes 204 as is well known in the art. The horizontal portion 206 extends radially towards the axis 45 above the jaw pins 20 with the inner, with respect to axis 45, end having a rigid depending gear segment 110 with gear teeth 131′ on the outermost periphery, with respect to axis 45, in driving engagement with the teeth 26 of jaw pins 20. Openings 201 are provided in portion 206 which are alignable with the jaw pins 20 to permit the removal of jaw pins 20 as previously discussed. Jaws 18′ differ from the jaws 18 in that only a die 60*m* is carried by the jaw body and accordingly the jaw body 72′ differs from the jaw body 72 in the portion for supporting the die 60*b* is eliminated. The die 61*m* is secured to jaw body 72′ by means of pin 81.

As shown in FIG. 9 the jaws 18′ are in the makeup position, with the body 72′ being of a form to engage the inner surface 75 of rotor 13′. Movement of rotor 13′ clockwise, in the manner as heretofore described, bodily moves the jaw pins 20 clockwise which are rotated clockwise relative to the rotor 13′ by the teeth 131′ of the brake plate 127′ since the brake plate 127′ is restrained from movement by the brake shoes 204. Clockwise movement of pin 20 relative to rotor 13′ rotates jaws 18′ clockwise and the dies 60*m* into engagement with a drill pipe 40 as heretofore described. Again as described, with dies 60*m* engaging the pipe 40 continued clockwise rotation of rotor 13′ rotates the pipe 40 until the desired makeup torque is applied. Counterclockwise rotation of rotor 13′ releases the die 60*m* from pipe 40 and rotates the pins 20 counterclockwise which in turn rotate the jaws 18′ counterclockwise to their original makeup position within rotor 13′. To obtain break-out the jaw pins 20 are removed in a manner, as previously described, and jaws 18′ removed from the rotor 13′ and reinserted into the rotor 13′ in the reverse manner so that the dies 60*m* shown also function, when reversed, as dies 60*b*. To reverse the jaws 18′ they are manually inverted outside the rotor 13′ and reinserted within rotor 13′. A more detailed description of the embodiment of FIGS. 9 and 10 is not necessary to the understanding of such structure in view of the prior description as to the same or similar functioning components. Further the gear teeth 131′ must be on a circle concentric with axis 45 and the arcuate components of FIGS. 9 and 10 which are modified with respect to the prior embodiment are on circles concentric with the axis 45. With the embodiment of FIGS. 9 and 10 the power tong is bidirectional only by reversing the position of the jaws 18′ with respect to the rotor 13′; however, such bidirectional operation is easily accomplished and does not require that the housing 10 be inverted during its use.

Having described the presently preferred embodiments of the invention in accordance with the Patent Statute it is to be realized that modifications to the structures described can be made without departing from the spirit and scope of the invention as defined in the following claims. In particular, although an open head tong is preferred, a closed head tong can be constructed in accordance with this invention.

What is claimed is:

1. A tong assembly comprising, a housing having an extent with a through opening therein, a plurality of engaging means supported by said housing with each of said engaging means being movable in opposite directions between two positions radially spaced from the central axis of said opening, said engaging means each having portions movable within the extent of said opening intermediate said positions to engage a portion of a member extending axially within said opening, said engaging means being pivotally supported with respect to said housing on axes parallel to and circumferentially spaced with respect to said central axis, said engaging means each having a pair of cam surfaces converging toward an apex spaced laterally outermost from said pivot axis and means carried by said housing for selectively simultaneously moving said engaging means between and into said positions and into engagement with such a portion of such a member at a third position intermediate said two positions, and said means being operable during such engagement whereby such a member is selectively rotatable in either one of opposite rotational directions with respect to the central axis of such member.

2. A tong assembly as set forth in claim 1 in which one of said cam surfaces being engageable with such a portion of such a member upon movement of said engaging means in one direction with respect to said two positions to rotate such a member in one direction with respect to the central axis of such a member and with the other of said cam surfaces being engageable with such a portion of such a member upon movement of said engaging means in a direction opposite said one direction with respect to said two positions to rotate such a member in a direction opposite said one direction with respect to the central axis of such a member.

3. A jaw assembly comprising, a jaw body having integral means for defining a pivot axis about which said body rotates in either one of opposite directions, said body having a pair of surface portions having extents converging towards an apex spaced laterally outermost from said pivot axis, said pivot axis being disposed adjacent a distal end of said jaw body with respect to said apex, member engaging cam die means supported by said surface portions respectively, one of said die means having an outer surface of a configuration to provide driving engagement for a member upon pivotal movement of said body about said pivot axis in one direction, the other said die means having an outer surface of a configuration to provide driving engagement for a member upon pivotal movement of said body member about said pivot axis in direction opposite said one direction, pin means received within said integral means and secured thereto, and gear means projecting generally radially with respect to said pivot axis means for effecting rotary motion to said jaw body through said pin means.

4. A tong assembly comprising, a housing having an axial extent with an open ended passageway extending inwardly from one side thereof with the inner portion of said passageway having a central axis extending transversely of said axial extent, means movably supported by said housing and extending in circumferentially spaced relationship with respect to said central axis, drive means carried by said housing and cooperable with said means for selectively rotating said means in either one of opposite directions about said central axis, jaw means bodily carried by said means for movement into position within said passageway in circumferentially spaced relationship with respect to said central axis and positions spaced radially outwardly from said first mentioned positions with respect to said central axis, each said jaw means having cam means for engaging a portion of a member extending axially within said passageway, and said means for movement having a circumferentially and radially open extent with respect to said axis.

5. A tong assembly comprising, a housing having a through opening therein with a central axis, said housing having alignable openings therein to provide an open head structure, a rotor movably supported by said housing and extending circumferentially with respect to said central axis, a power output drive carried by said housing and cooperable with said rotor for selectively rotating said rotor in either one of opposite directions about said central axis, a plurality of jaw members bodily carried by said rotor in circumferentially spaced relationship with respect to said central axis, each of said jaw members having convergent cam surfaces, each of said jaw members being movable between spaced positions relative to said rotor which are arcuately spaced relative to said central axis with the path of movement between such positions being at least in part within said opening, means supported by said housing and cooperable with all of said jaw members in one mode to selectively simultaneously move said jaw members into said positions upon rotation of said rotor in opposite rotational directions, respectively, and cooperable with said jaw members in another mode to rotate bodily with said jaw members.

6. A tong assembly as set forth in claim 5 in which each of said convergent cam surface have cam action dies thereon, respectively.

7. A tong assembly as set forth in claim 5 in which said jaw members includes gear teeth cooperable with gear teeth on said means to move said jaw members.

8. A tong assembly as set forth in claim 5 in which said means includes two portions biased into frictional engagement.

9. A tong assembly as set forth in claim 8 in which said two portions are continuously biased into frictional engagement.

10. A tong assembly as set forth in claim 8 in which said means includes an adjustable portion to vary such bias.

11. A tong assembly as set forth in claim 5 in which idler gear means simultaneously engages gear teeth on said jaw members, respectively, and said means to move said jaw members.

12. A tong assembly as set forth in claim 11 in which said idler gear means is bodily supported solely by said rotor.

13. A tong assembly as set forth in claim 5 in which said jaw members are located interiorly of the periphery of said rotor in said two positions.

14. A tong assembly as set forth in claim 13 in which said jaw members in said positions engage a surface of said rotor interiorly thereof.

15. A tong assembly as set forth in claim 6 in which said cam action dies have oppositely disposed camming surfaces.

16. A tong assembly as set forth in claim 5 in which means are selectively positioned with respect to said jaw members to preclude complete movement of said jaw members in one direction of movement of said jaw members between said two positions.

17. A tong assembly as set forth in claim 5 wherein said last mentioned means is locatable to prevent movement in either one of opposite directions of movement of said jaw members between said positions.

18. A tong assembly as set forth in claim 17 in which said rotor has indices to indicate the selected position of said last mentioned means.

19. A tong assembly as set forth in claim 9 in which said jaw members are of a structure to permit inversion thereof with respect to said rotor.

20. A tong assembly as set forth in claim 19 in which the opening of said openings in said means has a larger arcuate extent relative to said central axis than the openings of said openings in said rotor and said housing.

21. A tong assembly as set forth in claim 20 in which the opening of said openings in said means has sides selectively alignable with the sides of the opening of said opening in said housing.

* * * * *

UNITED STATES PATENT OFFICE

CERTIFICATE OF CORRECTION

PATENT NO. : 4,060,014

DATED : November 29, 1977

INVENTOR(S) : John Turner

It is certified that error appears in the above-identified patent and that said Letters Patent are hereby corrected as shown below:

In Column 1, line 7, delete "publically" and insert --publicly--.

In Column 3, line 51, delete "plate" and insert --plates--.

In Column 4, line 33, delete "verticaly" and insert --vertically--.

In Column 4, line 34, delete "roller" and insert --rollers--.

In Column 6, line 66, delete "positions" and insert --portions--.

In Column 8, line 49, delete "with" and insert --within--.

In Column 8, line 50, delete "35" and insert --34--.

UNITED STATES PATENT OFFICE
CERTIFICATE OF CORRECTION

PATENT NO. : 4,060,014

DATED : November 29, 1977

INVENTOR(S) : John Turner

It is certified that error appears in the above-identified patent and that said Letters Patent are hereby corrected as shown below:

In Column 9, line 8, delete "opening" and insert --openings--.

In Column 10, line 17, delete "in not" and insert --is not--.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*